US007637049B1

(12) United States Patent
Samson et al.

(10) Patent No.: US 7,637,049 B1
(45) Date of Patent: Dec. 29, 2009

(54) FIREARM MULTITOOL

(76) Inventors: Scott Samson, c/o Samson Manufacturing Corporation, 110 Christian La., Whatley, MA (US) 01373; David Beaudet, c/o Samson Manufacturing Corporation, 110 Christian La., Whatley, MA (US) 01373

( * ) Notice: Subject to any disclaimer, the term of this patent is extended or adjusted under 35 U.S.C. 154(b) by 0 days.

(21) Appl. No.: 12/506,754

(22) Filed: Jul. 21, 2009

Related U.S. Application Data

(63) Continuation of application No. 12/353,808, filed on Jan. 14, 2009, now abandoned.

(60) Provisional application No. 61/116,960, filed on Nov. 21, 2008.

(51) Int. Cl.
*F41C 27/00* (2006.01)

(52) U.S. Cl. ..... 42/108; 42/90; 42/95; 42/107; 7/118; 7/168; 81/3.05

(58) Field of Classification Search ..... 42/72, 42/90, 95, 107, 108; 7/118, 167, 168; 81/3.05, 81/48; 89/1.42
See application file for complete search history.

(56) References Cited

U.S. PATENT DOCUMENTS

| | | | | |
|---|---|---|---|---|
| 2,744,275 | A * | 5/1956 | Geltner | 401/18 |
| 3,564,950 | A * | 2/1971 | Jorczak | 81/3.05 |
| 4,163,334 | A | 8/1979 | Tollinger | |
| 4,477,979 | A | 10/1984 | Oren | |
| 4,819,289 | A | 4/1989 | Gibbs | |
| 4,949,496 | A * | 8/1990 | Stephan | 42/90 |
| 5,159,136 | A * | 10/1992 | Marsh | 42/71.01 |
| 5,394,729 | A | 3/1995 | Eisenhower, Jr. | |
| 5,416,940 | A | 5/1995 | Bandera | |
| 5,924,233 | A | 7/1999 | Strobel | |
| 6,173,519 | B1 * | 1/2001 | Garrett | 42/90 |
| 6,230,430 | B1 | 5/2001 | Gosselin | |
| 6,389,729 | B2 | 5/2002 | Rauch et al. | |
| 6,536,152 | B1 | 3/2003 | Wisz | |
| 6,640,480 | B2 | 11/2003 | Williams et al. | |
| 6,701,658 | B1 | 3/2004 | Brownell | |
| 6,854,205 | B2 * | 2/2005 | Wikle et al. | 42/71.02 |
| 6,874,266 | B1 * | 4/2005 | Kong | 42/71.01 |
| 6,981,344 | B2 | 1/2006 | Cahill et al. | |
| 7,117,626 | B1 | 10/2006 | Alzamora et al. | |
| 2006/0162224 | A1 * | 7/2006 | Connal | 42/108 |
| 2009/0145785 | A1 * | 6/2009 | Garrett | 206/223 |
| 2009/0199345 | A1 * | 8/2009 | Morgan | 7/118 |

* cited by examiner

*Primary Examiner*—Michael Carone
*Assistant Examiner*—Gabriel J Klein
(74) *Attorney, Agent, or Firm*—Burns & Levinson LLP; Bruce D. Jobse

(57) ABSTRACT

A multitool for a firearm provides a frame adapted for storage within a handgrip cavity of a firearm and a plurality of tools rotatably mounted to the frame to move from within the frame to extending from the frame as a result of being rotatably mounted, wherein the plurality of tools are adapted for use to rehabilitate the firearm under predetermined malfunction conditions.

18 Claims, 8 Drawing Sheets

FIREARM MULTITOOL

CROSS REFERENCE TO RELATED APPLICATIONS

This application is a continuation of co-pending U.S. patent application Ser. No. 12/353,808, filed Jan. 14, 2009, entitled FIREARM MULTITOOL, which in turn claims priority from U.S. Provisional Patent Application Ser. No. 61/116,960, filed Nov. 21, 2008, entitled FIREARM MULTITOOL, which are incorporated herein by reference in their entirety.

FIELD OF THE INVENTION

The present invention generally relates to tools used to work on firearms, and in particular to such tools which can be carried within the firearm.

BACKGROUND OF THE INVENTION

The proper operation of a military firearm is of critical importance in combat situations. Unfortunately, a variety of firearm malfunctions can occur that render the firearm useless until repairs can be performed, and these repairs typically include the use of proper tools.

In view of the above importance of performing necessary repairs on an inoperative firearm, it would be beneficial to have ready and useful access to a collection of tools suitable for correcting several different types of firearm malfunctions.

SUMMARY OF THE INVENTION

One embodiment of the present invention provides a multitool for a firearm, comprising: a frame adapted for storage within a handgrip cavity of a firearm; and a plurality of tools rotatably mounted to the frame to move from within the frame to extending from the frame, wherein the plurality of tools are adapted for use to rehabilitate a firearm under predetermined malfunction conditions.

The plurality of tools may include a carbon scraper and a broken shell extractor. The frame may include a gun site adjustment feature. The frame may include a slot feature sized to engage sheet metal on a firearm magazine to facilitate bending of the sheet metal. The plurality of tools may be rotatably mounted to extend from the frame at a sufficient angle to significantly increase leverage which may be applied from the handle to each of the plurality of tools. One or more of the plurality of tools may be suitable for similar usage with a companion firearm such as a hand gun, while the frame is adapted for location within the grip of a rifle.

The multitool may further comprise a base member connected to the frame and located to extend from a handgrip cavity when the frame is stored therein and further adapted to enable removal of the frame from the cavity. The multitool may further comprise an elastic member located between the frame in the base member and adapted to extend outward under compression between the frame and the base member to engage sides of a handgrip cavity for retaining the frame therein. The frame may include a mechanism controllable through the base member and adapted to extend outwardly from the frame to engage sides of a handgrip cavity. The base may be adapted to rotate to facilitate removal of the frame from the cavity.

BRIEF DESCRIPTION OF THE DRAWINGS

The present invention is illustratively shown and described in reference to the accompanying drawings, in which.

DETAILED DESCRIPTION OF THE INVENTION

Figure 1:
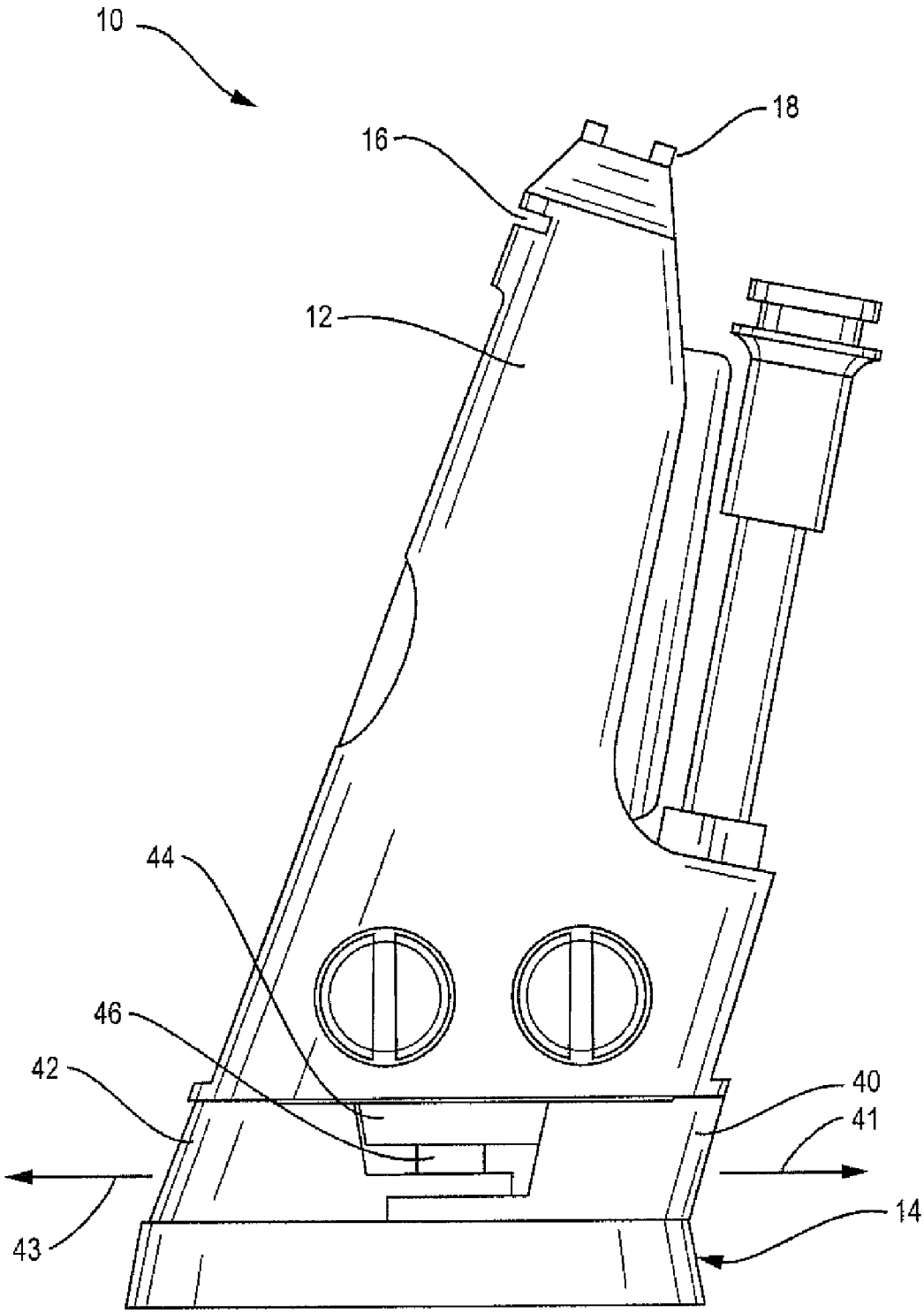
FIG. 1 shows a side view of a firearm multitool constructed in accordance with one embodiment of the present invention.

FIG. 1 shows a multitool 10 adapted for storage within the handgrip of a rifle. Multitool 10 generally includes a frame 12 and a base 14. Multitool 10 is adapted for such storage by being shaped to properly fit within a handgrip cavity while using the available space to its advantage. Thus, the sides of frame 12 are canted with respect to base 14 in the general shape of a firearm handgrip. A slot 16 and a gun sight adjustment tool 18 are integrally constructed in frame 12.

Figure 2:
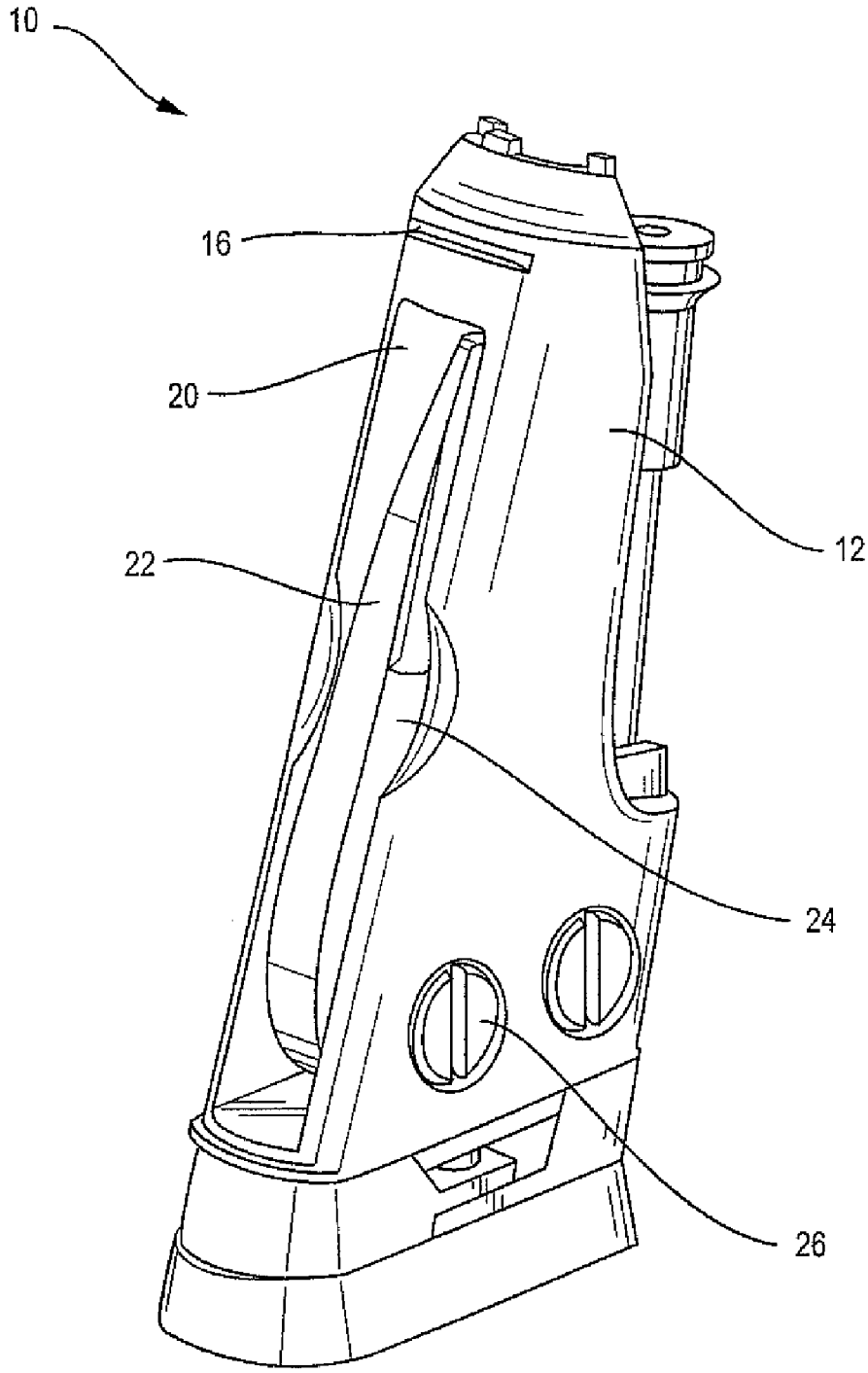
FIG. 2 shows a perspective view of the multitool of FIG. 1.

FIG. 2 is a perspective view of multitool 10 showing a first cavity 20 within which are located a screwdriver 22 and a carbon scraper 24. Screwdriver 22 and scraper 24 all are rotatably mounted by screw 26 to frame 12. Slot 16 is sized to allow the sheet metal from a cartridge magazine to fit within slot 16 to allow multitool 10 to be used for bending the sheet metal. Cartridge magazines are commonly bent or damaged around the shell opening and having the proper bend on that sheet metal can easily effect functionality of a firearm.

Figure 3:
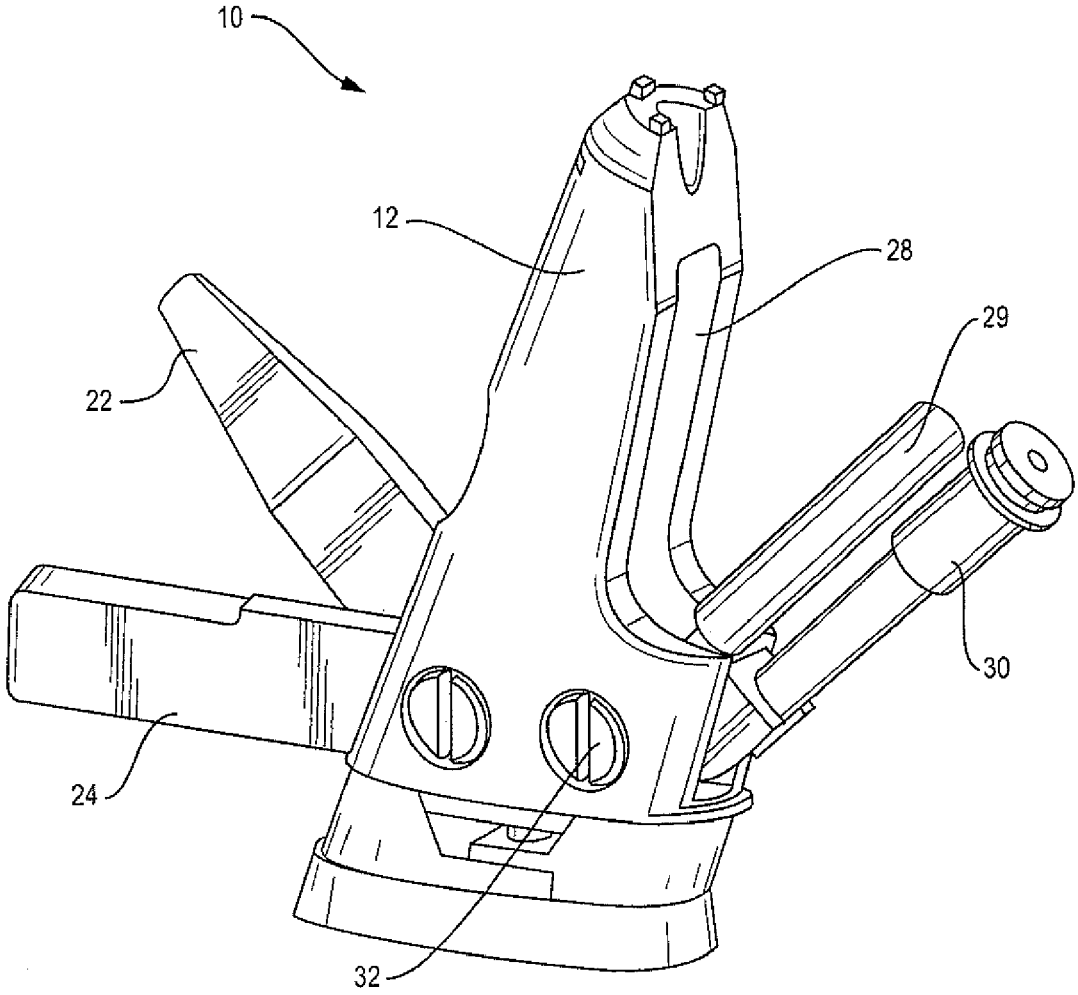
FIG. 3 shows a different perspective view of the multitool of FIG. 2 having its tools extending therefrom.

FIG. 3 shows another perspective view of multitool 10 having cavity 28 into which a brush 29 and a broken shell extractor 30 are adapted to be partially located. Extractor 30 is rotationally mounted to frame 12 by screw 32. FIG. 3 also shows screwdriver 22 and scraper 24 extending from frame 12 as well as a better view of gun sight adjustment tool 18. The extended position of each tool allows frame 10 to be used for exerting additional torque or leverage in the use of each tool.

FIGS. 1-3 also show a retention system for securing multitool 10 into a standard hand grip. Located adjacent the frame 12 and constructed as part of base 14 are a pair of moveable members 40, 42 which are adapted for sliding expansion in the direction of their respective arrows 41, 43, to extend from multitool 10 and provide for its retention. This expansion of members 40, 42 is caused by wedge member 44, which forces members 40, 42 apart as wedge 44 is pulled closer to base 14. This pulling may be accomplished by any suitable means, such as a screw 46, accessible from the bottom of base 14. With multitool 10 located within a standard hand grip, the pulling of wedge member 44 towards base 14 causes either one or both of members 40, 42 to extend from multitool 10 and press against the insides of the hand grip. To retract multitool 10 from a hand grip, wedge member 44 is released to allow members 40, 42 to be retracted and disengage the inside of the hand grip. Simple fore and aft pressure on base 14 in the direction of respective arrows 41, 43 is sufficient to ensure the proper retraction of members 40, 42, once wedge member 44 is released. The head of screw 46 may take the form of a thumbscrew or other form not requiring a tool.

Figure 4:
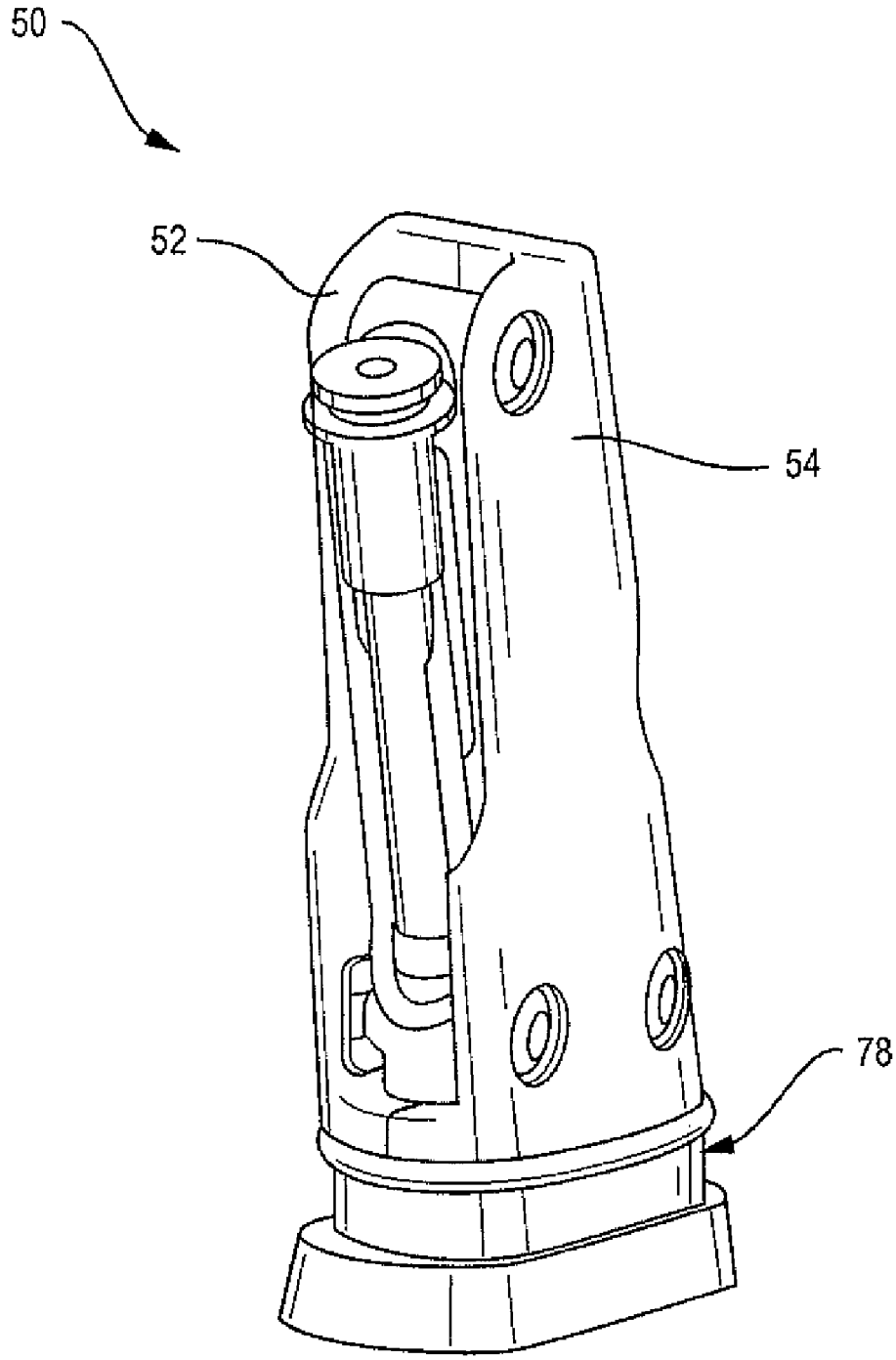
FIG. 4 shows a perspective view of a firearm multitool constructed in accordance with another embodiment of the present invention.
Figure 5:
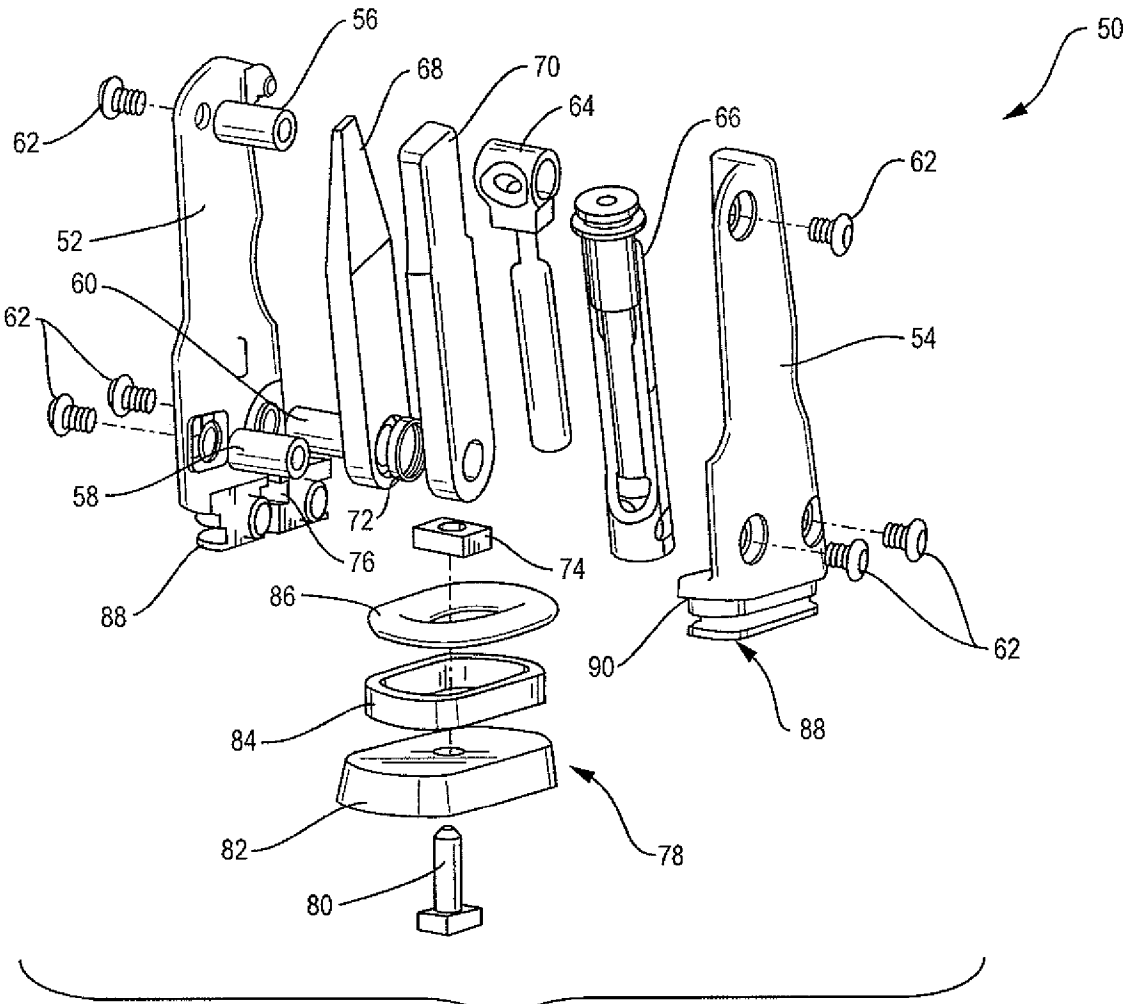
FIG. 5 is an exploded view of the parts of the firearm multitool of FIG. 4.
Figure 6:
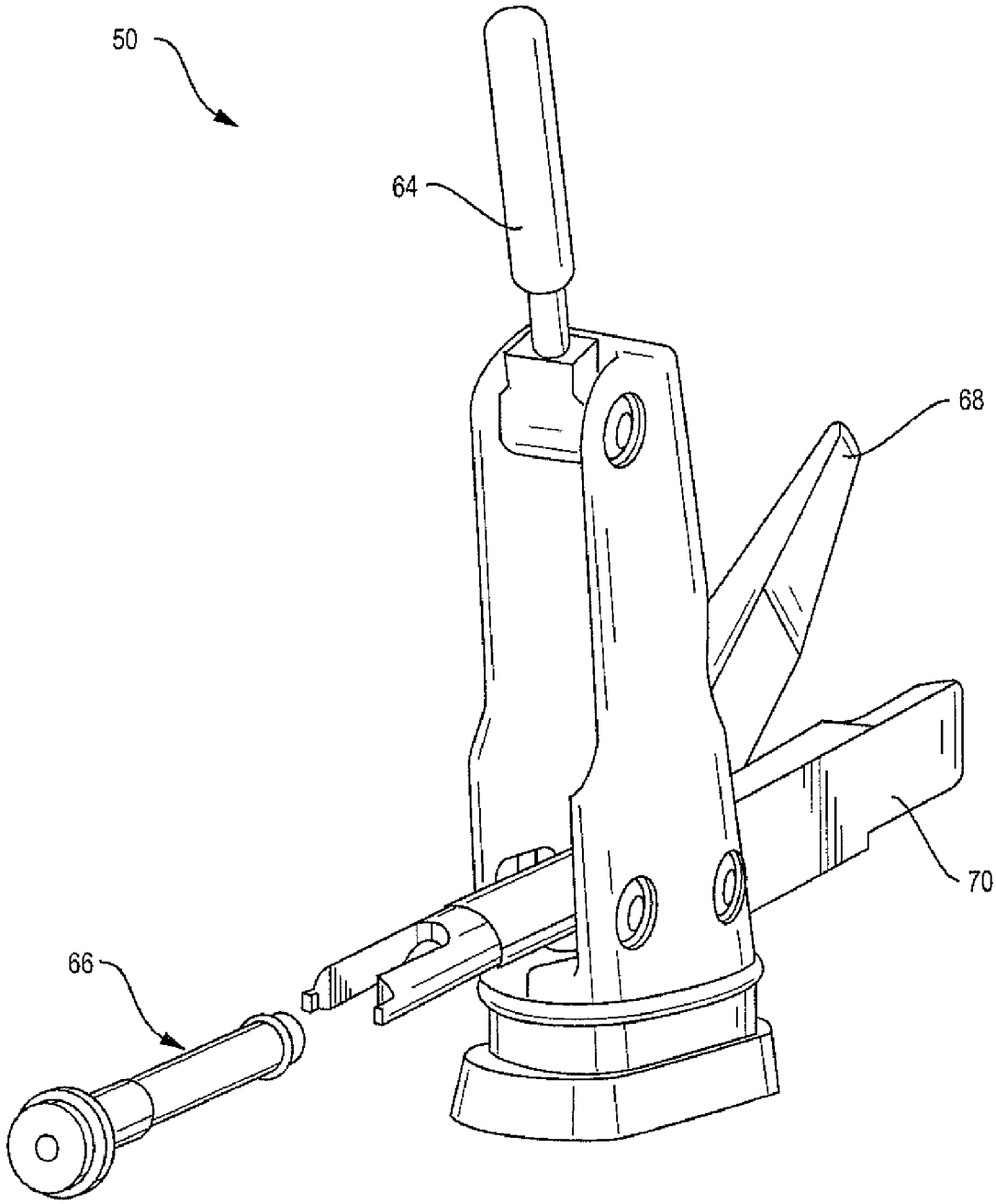
FIG. 6 is a perspective view of the firearm multitool of FIGS. 4 and 5 having tools extending therefrom.

FIGS. 4 and 6 show perspective views of a firearm multitool 50 constructed in accordance with another embodiment of the present invention. FIG. 5 shows the parts of multitool 50 in an exploded condition. Multitool 50 includes a pair of frame-halves 52, 54 that are interconnected by three axial spacers 56, 58, 60, each secured by rivets or screws 62 passing through frame-halves 52, 54. Frame-halves 52, 54 function as opposing grips for multitool 50.

Axial spacers 56, 58, 60 maintain the spacing between frame-halves 52, 54 while providing rotational axles for the various tools that are rotatably mounted thereto. A brush 64 is adapted for mounting on spacer 56. Also, a cartridge extractor 66 is adapted for rotational mounting on spacer 58, and both screwdriver 68 and scraper 70 are adapted for mounting on spacer 60. Also intended from location on spacer 60 is a separation spring 72 to facilitate independent rotation of both screwdriver 68 and scraper 70.

When frame-halves 52, 54 are secured together, a nut 74 is simultaneously retained in a separate complementary recess 76 in each of the frame-halves 52, 54. Nut 74 is used for the attachment of a base assembly 78 to frame-halves 52, 54. Base assembly 78 includes a retention screw 80, a base member 82, a base collar 84 and a flexible O-ring 86. When frame-halves 52, 54 are assembled, they provide a circumferential flange 88 which extends around the bottom of frame-halves 53, 54. Flange 88 includes a lip 90 against which O-ring 86 is located. Collar 84 is also located around flange 88 and contacts the bottom of O-ring 86. Base member 82 contacts base collar 84, and retention screw 80 passes through base member 82 to engage nut 74. The action of retention screw 80 forces collar 84 against O-ring 86, causing compressive lateral expansion thereof. This lateral expansion of O-ring 86 is sufficient to engage the sides of a firearm handgrip cavity and retain multitool 50 within the handgrip.

Figure 7:
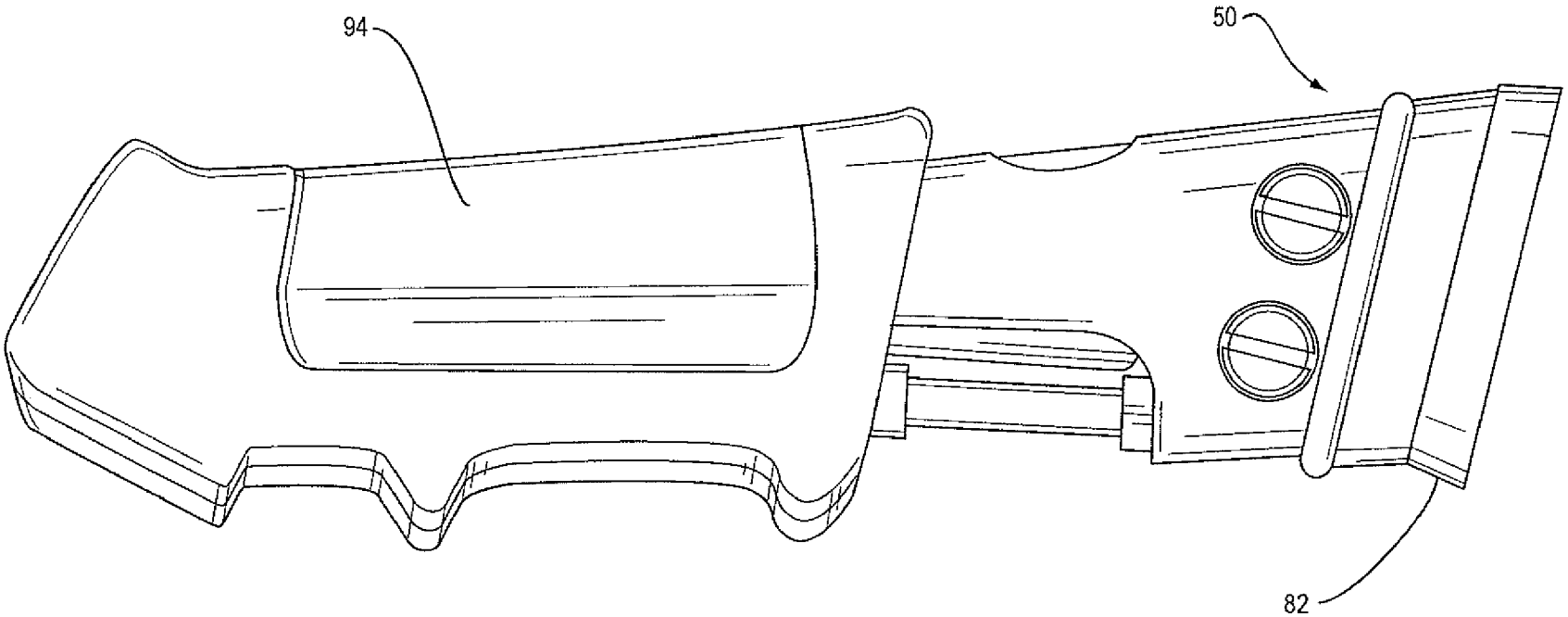
FIG. 7 is a side view of the firearm multitool of FIGS. 4-6 partially inserted into a standard firearm handgrip.
Figure 8:
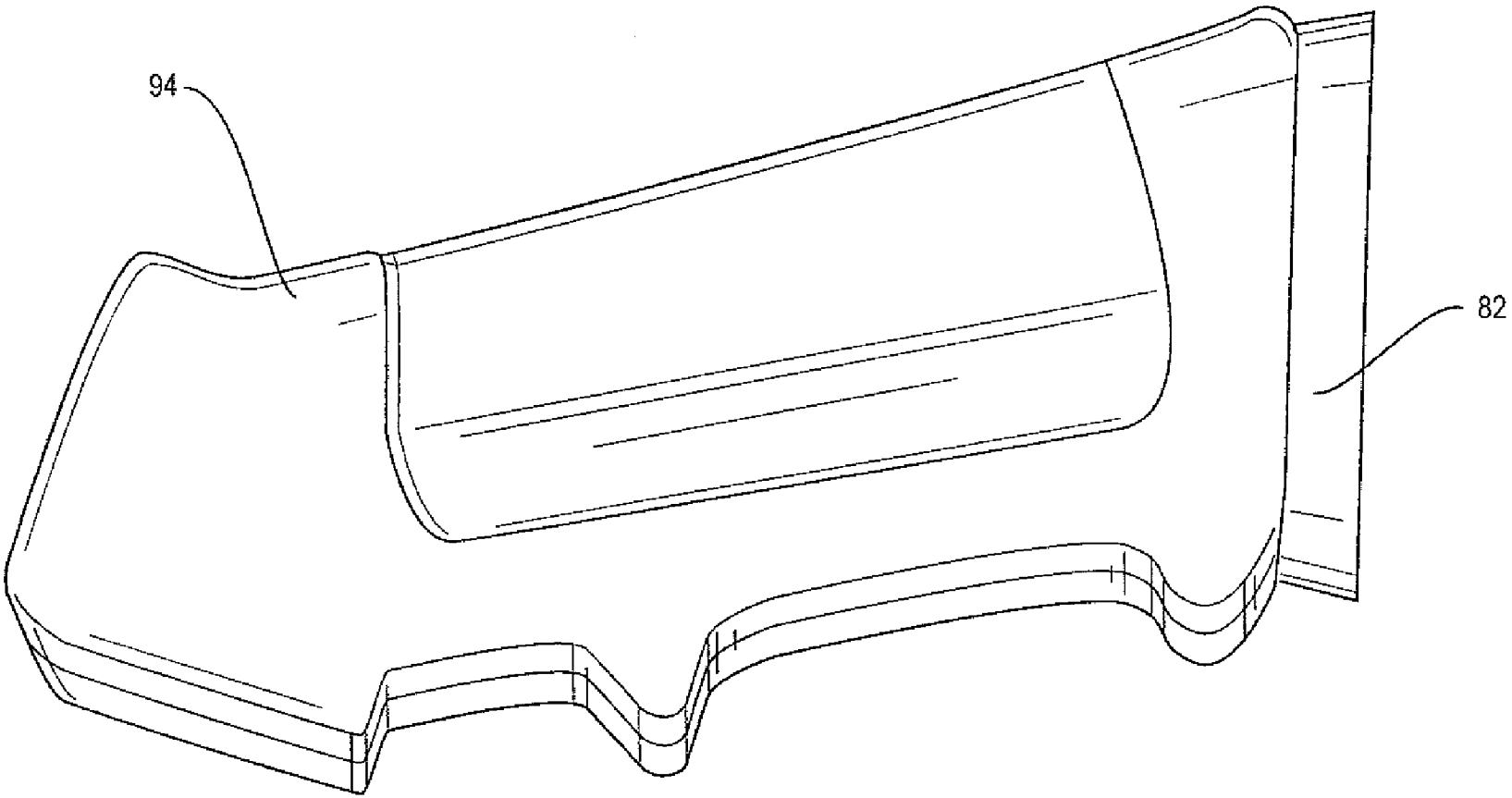
FIG. 8 is a side view of the firearm multitool of FIG. 7 fully inserted into the standard handgrip.

FIG. 7 shows the multitool 50 partially inserted into a standard firearm handgrip 94, which can be an A2 Pistol grip for the M16/M4 Weapons System. FIG. 8 shows the multitool 50 fully inserted into handgrip 94. In this position, base member 82 still extends from handgrip 94 and can thereby be accessed to enable the extraction of multitool 50 from handgrip 94. In different embodiments, base 82 may be adapted to rotate to extend laterally from handgrip 94 and enable greater leverage to be applied for the extraction of multitool 50. The rotation of bases 82 and 14 may also function to loosen their respective screws 80 and 46.

In the manner described above, the present invention may be used for servicing a firearm in several ways that can rehabilitate a serious malfunction. Thus, the present invention can play a critical role in maintaining the usefulness of a firearm, and the ability to store multitool within a standard handgrip for a firearm makes the multitool readily and always available for use with the firearm. In the case of companion firearms, such as certain rifle and handgun combinations, a single multitool may be constructed to service both weapons.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A multitool for a firearm, comprising:

a frame shaped for storage within a handgrip cavity of a firearm; a plurality of tools rotatably mounted to the frame to move from within the frame to extending from the frame, wherein the plurality of tools are adapted for use to rehabilitate a firearm under predetermined malfunction conditions; a base member coupled to the frame and located to extend from the handgrip cavity when the frame is stored therein and further adapted to enable removal of the frame from the cavity; and an elastic member located between the frame and the base member and adapted to extend outward under compression between the frame and the base member to engage sides of a handgrip cavity for retaining the frame therein.

2. The multitool of claim 1, wherein the plurality of tools comprises one of a carbon scraper and a broken shell extractor.

3. The multitool of claim 1, wherein the frame comprises a gun site adjustment feature.

4. The multitool of claim 1, wherein the frame comprises a slot feature sized to engage sheet metal on a firearm magazine to facilitate bending of the sheet metal.

5. The multitool of claim 1, wherein the plurality of tools are rotatably mounted to extend from the frame at a sufficient angle to significantly increase leverage which may be applied from the frame to each of the plurality of tools.

6. The multitool of claim 1, wherein one or more of the plurality of tools are suitable for similar usage with a companion firearm, while the frame is adapted for location within the grip of a rifle.

7. The multitool of claim 1, wherein the base member is adapted to extend outwardly from the frame to engage sides of a handgrip cavity.

8. The multitool of claim 1, wherein a portion of the base member is adapted to rotate to facilitate removal of the frame from the cavity.

9. A multitool for a firearm, comprising:

a frame shaped for storage within a handgrip cavity of a firearm;

a least one tool moveably mounted to the frame; and a base member rotatably coupled to the frame and at least partially disposed external of the handgrip cavity when the frame is stored within the handgrip cavity.

10. The multitool of claim 9, wherein the base member further comprises:

a mechanism responsive to rotational movement of the base member and adapted to move the frame relative to an interior surface of the handgrip cavity.

11. The multitool of claim 10, wherein the mechanism comprises an elastic member at least partially disposed exterior of the frame and adapted to extend outward under compression to engage the interior surface of the handgrip cavity.

12. The multitool of claim 10, wherein the mechanism comprises a pair of extension members adapted for movable expansion relative to the interior surface of the handgrip cavity in response to rotational movement of the base member.

13. The multitool of claim 9, further comprising a plurality of tools moveably mounted to the frame.

14. The multitool of claim 13, wherein the plurality of tools comprise one of a screwdriver and a brush.

15. The multitool of claim 9, wherein the frame comprises a pair of frame halves separated by at least one axial spacer to which the at least one tool is movably mounted.

16. A multitool for a firearm, comprising: a frame shaped for storage within a cavity of a firearm handgrip; at least one tool moveably mounted to the frame; and a base member rotatably coupled to the frame and at least partially disposed external of the handgrip cavity when the frame is stored within the handgrip cavity; and a mechanism movably coupled to the frame and responsive to rotational movement of the base member and adapted to cause the frame to contact an interior surface of the handgrip cavity.

17. The multitool of claim 16, further comprising:

an elastic member at least partially disposed within a lip of the frame and adapted to expand outward to frictionally engage the interior surface of a handgrip cavity when compressed between the frame and base member.

18. The multitool of claim 16, wherein the mechanism comprises a collar disposed intermediate the elastic member and the base member and adapted to transmit rotational movement of the base member into force on the elastic member.

* * * * *